US006149374A

United States Patent [19]

Dershem et al.

[11] Patent Number: 6,149,374

[45] Date of Patent: Nov. 21, 2000

[54] RELEASABLE LOCKING MECHANISM FOR A LIFTARM OF A MACHINE

[75] Inventors: Brian R. Dershem, Snaford; Steven F. Reynolds, Cary; Matthew P. Rosefsky, Chapel Hill, all of N.C.

[73] Assignee: Caterpillar S.A.R.L., Geneva, Switzerland

[21] Appl. No.: 09/161,351

[22] Filed: Sep. 25, 1998

[51] Int. Cl.[7] ..... B66C 23/00

[52] U.S. Cl. ..... 414/685; 212/292

[58] Field of Search ..... 414/680, 685; 188/167; 298/17 B; 172/466, 481; 212/292; 92/14, 15, 16, 17, 18, 19, 20, 21 MR, 23, 24, 25

[56] References Cited

U.S. PATENT DOCUMENTS

| | | | |
|---|---|---|---|
| 4,947,705 | 8/1990 | Yates et al. | 92/25 X |
| 5,009,566 | 4/1991 | Asche | 414/722 |
| 5,634,762 | 6/1997 | Kim | 414/685 |
| 5,836,232 | 11/1998 | Williams | 92/14 |

FOREIGN PATENT DOCUMENTS

| | | | |
|---|---|---|---|
| 2009581 | 6/1979 | United Kingdom | 172/466 |

*Primary Examiner*—Donald W. Underwood
*Attorney, Agent, or Firm*—Diana L. Charlton

[57] ABSTRACT

A releasable locking mechanism has a lockbar which locks a hydraulic cylinder in an extended position for holding a liftarm assembly of a machine in a raised position. The lift cylinder has a body and an extendable rod which incorporates structure thereon acting upon the lockbar to release the locked hydraulic cylinder so that the liftarm assembly is moved from the raised position to a lowered position with minimal operator intervention. The operator intervention occurs only when the liftarm assembly is in the lowered position or when the lift cylinder is locked in the extended position. The lockbar is movable between an inoperative position wherein the lockbar is releasably connected to the liftarm assembly and an operative position wherein the lockbar is in bearing engagement with the body of the lift cylinder to prevent retraction of the rod. A release lever is connected to a lift cylinder and is movable between a rest position wherein the release lever is adjacent and substantially parallel with the lift cylinder and a working position wherein a notched end portion of the release lever is forced against a pin assembly releasably connected on the lockbar to lift the lockbar out of bearing engagement with the body of the lift cylinder.

22 Claims, 12 Drawing Sheets

60
138
74
142
70
162
134
10
150
78
80
10
130
190
158
40
120
86
124

60
142
74
70
300
78
190
320
40
86

60
142
74
300
70
134
78
190
40
86

60
142
74
70
78
300
134
190
40
86

60
74
304
142
308
306
70
134
310
86

RELEASABLE LOCKING MECHANISM FOR A LIFTARM OF A MACHINE

TECHNICAL FIELD

This invention relates generally to a locking mechanism for maintaining the extension of a lift actuator operatively associated with a liftarm of a machine and more particularly to the ability to release the locking mechanism, both with limited intervention from an operator.

BACKGROUND ART

It is well known that a machine, such as a skid steer loader, typically includes a boom or liftarm stop member. The stop member is normally used to retain a lift cylinder in an extended state which holds the liftarm in a raised position, generally for specific machine repair purposes. Disengagement of the stop member usually requires that the lift cylinder be extended and the stop member manually moved to an inoperative position in order to lower the liftarm. Some designs, however, have utilized an automatic retraction system on the stop member to avoid the manual movement of the stop member to the inoperative position.

A design disclosed in U.S. Pat. No. 5,634,762 issued to In K. Kim on Jun. 3, 1997 utilizes a prop arm hingedly attached to a boom for swinging movement between a rest position parallel to the boom and a propping position in a bearing engagement with the distal end of a boom cylinder housing to maintain the boom in a raised position against retraction of a boom cylinder piston rod. A release lever is pivotally attached to the free end of the prop arm and movable between an idle position in which the release lever is folded back onto the prop arm, an unfolded position in which the tip end of the release lever rides on the cylinder housing, and an arm lifting position in which the release lever bears against the piston rod at the tip end thereof to lift the prop arm out of engagement with the distal end of the cylinder housing. The pressure and action of the release lever while riding along the cylinder housing causes damage to the outer surface of the cylinder housing. Additionally, the utilization of the prying action of the release lever against the cylinder housing may damage the cylinder. Furthermore, the orientation and positioning of the release lever on the prop arm may promote buckling of the release lever and subsequent necessity for replacement.

A design disclosed in U.S. Pat. No. 5,009,566 issued to James E. Asche on Apr. 23, 1991 utilizes a retractable boom stop. The retractable boom stop is movable between an inoperative position adjacent the boom arm and an operative position interposed between the boom arm and lift cylinder. The stop member is secured in the inoperative position by a retaining pin. A tension spring carried by the stop member and releasably securable to the boom arm automatically retracts the stop member out of the operative position to allow the lift cylinder to be retracted. The utilization of the tension spring may require frequent replacement for wear on the spring brought about by extended usage. Additionally, in some harsh environments, the spring may not function properly which may lead to increased operator involvement in retracting the boom stop. Furthermore, the high tension on the spring, which is necessary for proper functioning, may be difficult to "stretch" into operation and may, thereby, cause pinching to an operator's fingers.

The present invention is directed to overcoming the problems as set forth above.

DISCLOSURE OF THE INVENTION

In one aspect of the present invention, a releasable locking mechanism is disclosed which is adapted for use with a liftarm. The liftarm is connected to and operatively associated with a lift cylinder for movement between raised and lowered positions. The lift cylinder has a body and an extendable rod. The releasable locking mechanism comprises a lockbar with first and second end portions. The second end portion is pivotally connected to the liftarm for movement between an inoperative position wherein the first end portion is releasably connected to the liftarm and an operative position wherein the first end portion is in bearing engagement with the body of the lift cylinder to prevent retraction of the rod. The releasable locking mechanism further comprises a release lever releasably connected to the body of the lift cylinder with a notched end portion. The release lever is movable between a rest position wherein the release lever is adjacent and substantially parallel with the lift cylinder and a working position wherein the notched end portion of the release lever is forced against the first end portion of the lockbar to lift the lockbar out of bearing engagement with the body of the lift cylinder.

In another aspect of the present invention, a machine has a body and comprises a liftarm, a lift cylinder, and a releasable locking mechanism. The liftarm is pivotally mounted to the body. The lift cylinder has a housing pivotally mounted to the body of the machine and an extendable rod connected to the liftarm. The lift cylinder is operatively associated with the liftarm for moving the liftarm between raised and lowered positions. The releasable locking mechanism includes a lockbar and a release lever. The lock bar has first and second end portions with the second end portion pivotally connected to the liftarm for movement between an inoperative position wherein the first end portion is releasably connected to the liftarm and an operative position wherein the first end portion is in bearing engagement with the housing of the lift cylinder to prevent retraction of the rod. The release lever is pivotally connected to the housing of the lift cylinder.

In yet another aspect of the invention, a method of locking a lift cylinder with a body and an extendable rod in an extended position in order to hold a lift arm of a machine in a raised position and releasing the locking of the lift cylinder in order to bring the lift arm to a lowered position is disclosed. The method of locking and releasing the lift cylinder comprises providing a lockbar with first and second end portions and a release lever with a notched end portion. Then, pivotally connecting the second end portion of the lockbar to the lift arm. Next, pivotally connecting the release lever to the body of the lift cylinder. Then, moving the lockbar from an inoperative position wherein the first end portion is releasably connected to the liftarm to an operative position wherein the first end portion is in bearing engagement with the body of the lift cylinder to prevent retraction of the rod. Finally, moving the release lever from a rest position adjacent and substantially parallel with the lift cylinder to a working position wherein the notched end portion is forced against the first end portion of the lockbar to lift the lockbar out of bearing engagement with the body of the lift cylinder.

The present invention incorporates a release lever connected to a lift cylinder which has a notched end portion for forcing a lockbar out of bearing engagement with the lift cylinder. The location of the release lever on the lift cylinder and the interaction with the lockbar during disengagement from the lift cylinder provides an effective releasable locking mechanism which directly works against the lockbar to avoid damage to the lift cylinder.

BEST MODE FOR CARRYING OUT THE INVENTION

Figure 1:
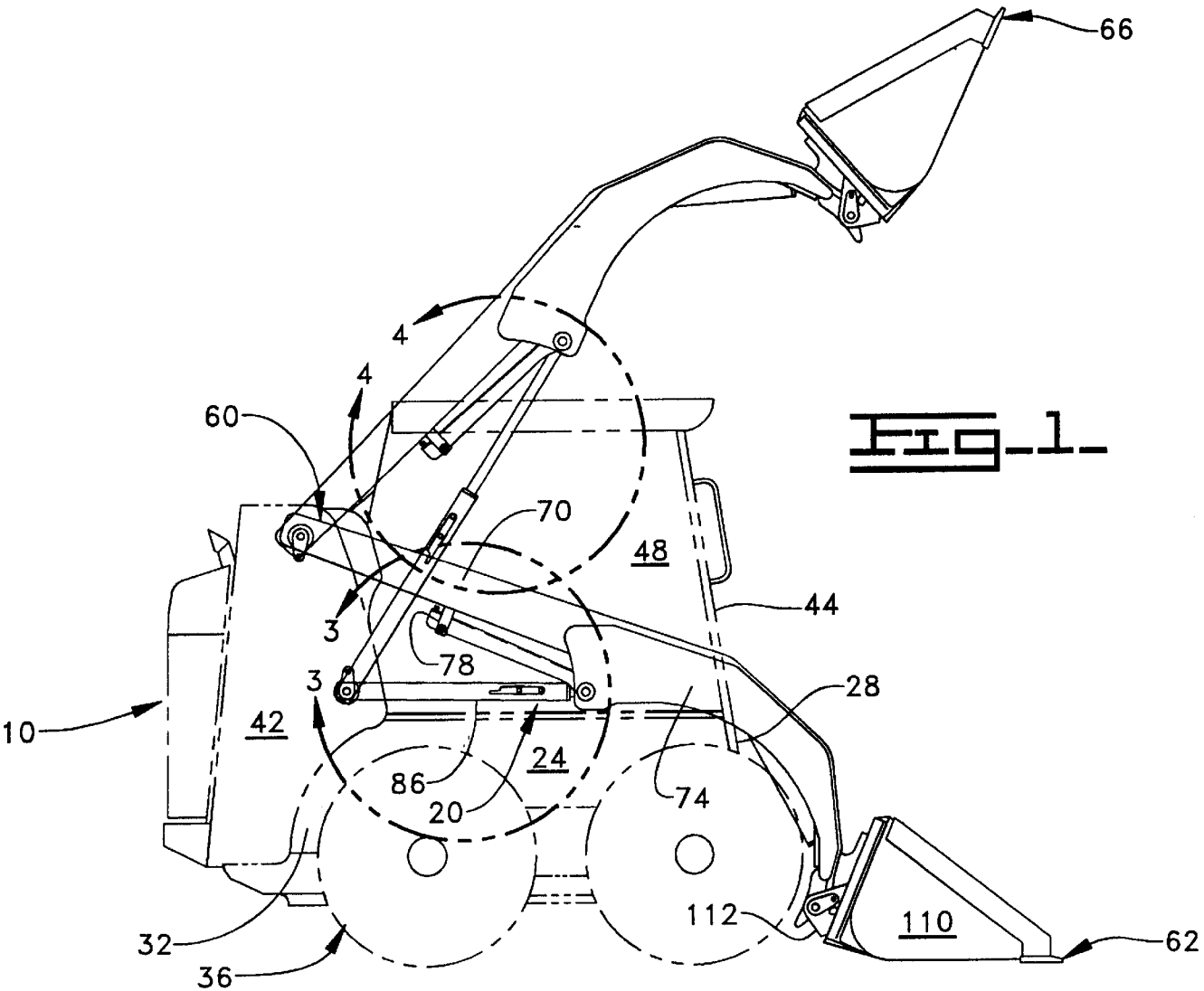
FIGS. 1–2 are side elevational views showing a skid steer loader machine utilizing a releasable locking device in accordance with the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
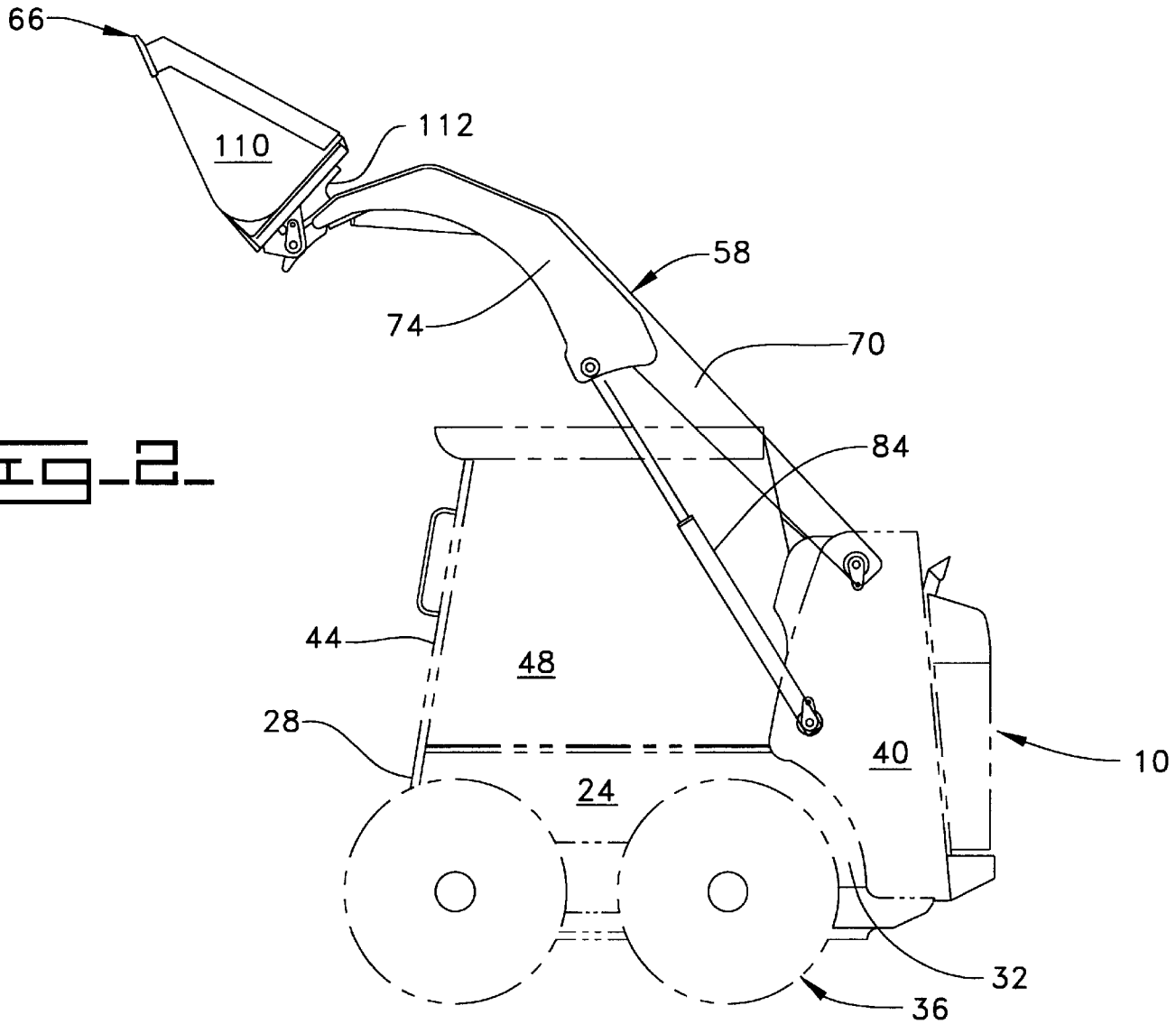
Figure 4:
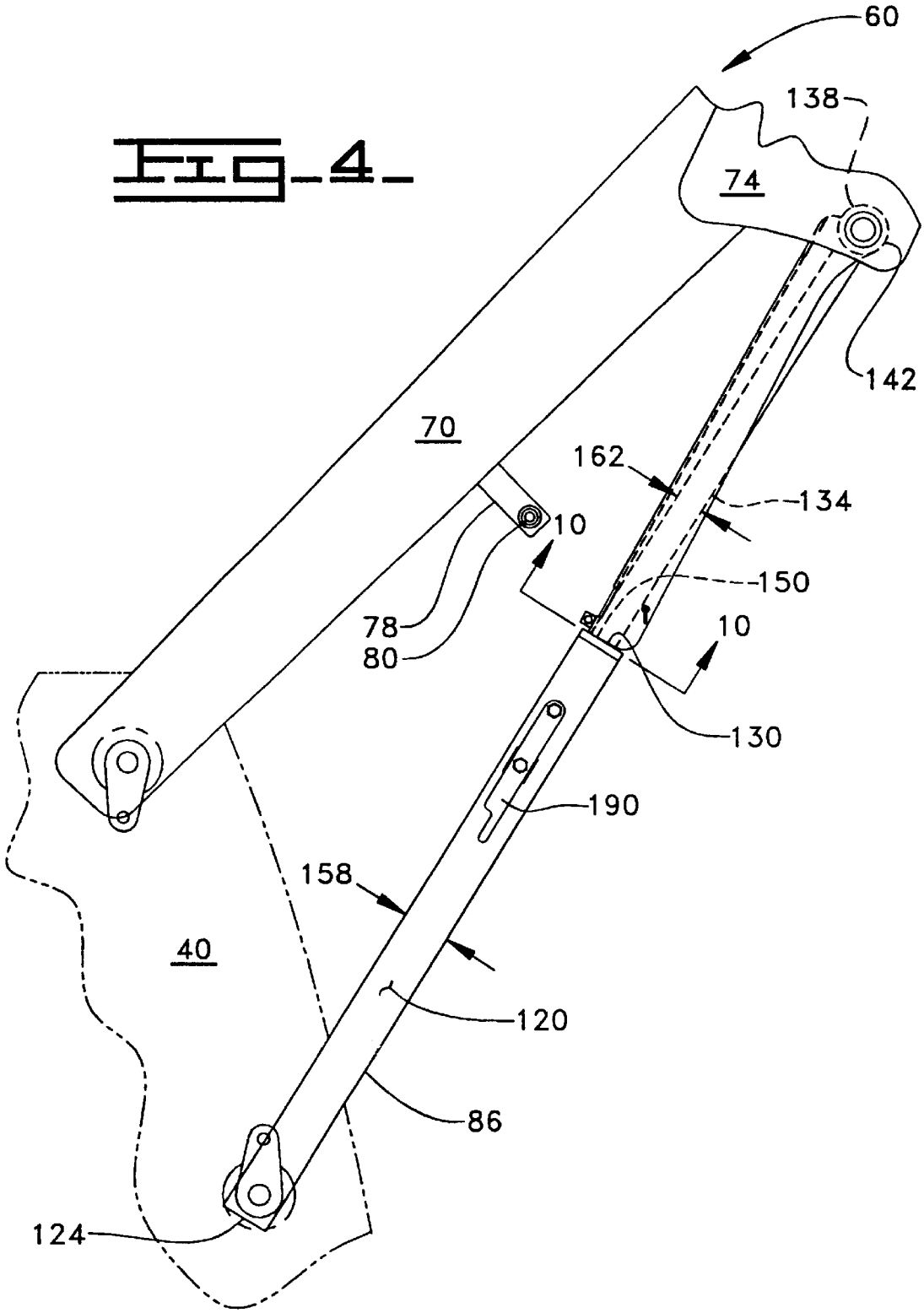

Referring to FIGS. 1–2, a construction machine 10, such as a skid steer loader, is shown incorporating a releasable locking mechanism 20 in accordance with the present invention. The skid steer loader 10 includes a machine frame 24 with front and rear end portions 28,32 supported by a plurality of wheels 36. The frame 24 includes left and right upright tower assemblies 40,42 which are positioned on the rear end portion 32 thereof. A cab 44 is mounted on the front end portion 28 of the frame 24 for partially enclosing an operator (not shown) within an operating compartment 48. Left and right liftarm assemblies 58,60 are pivotally mounted to the respective corresponding left and right tower assemblies 40,42 for movement between lowered and raised positions 62,66. The liftarm assemblies 58,60 each have a boxed liftarm portion 70 and a pair of curved, sideplate portions 74 connected in a spaced relationship on the boxed liftarm portion 70. A stow bar 78, seen more clearly in FIG. 4, is connected in any suitable manner, such as welding, to the boxed liftarm portion 70 of the right liftarm assembly 60 and extends downwardly from a bottom surface thereof. The stow bar 78 has a defined opening 80 therethrough. Left and right lift actuators 84,86 are used to lower and raise the respective corresponding left and right liftarm assemblies 58,60. The lift actuators 84,86 may be conventional hydraulic or pneumatic cylinders or other linear acting actuators. An attachment, such as a bucket 110, is connected to the liftarm assemblies 58,60 at the sideplate portion 74 thereof via a coupler 112 or any other suitable method and is operable in a well known manner. The left and right liftarm assemblies 58,60 and respective lift actuators 84,86 may be substantially identical to each other, but only the right liftarm assembly 60 and lift actuator 86 are discussed in further detail herein. It should be understood that although the present invention is used in conjunction with the right liftarm assembly 60, it could easily be modified to function with any lift arm assembly or any mechanism utilizing a lift actuator. It should also be understood that the releasable locking mechanism 20 may be used on any suitable machine which utilizes similar structure to that shown by the skid steer loader 10 described in the present invention.

Figure 11:
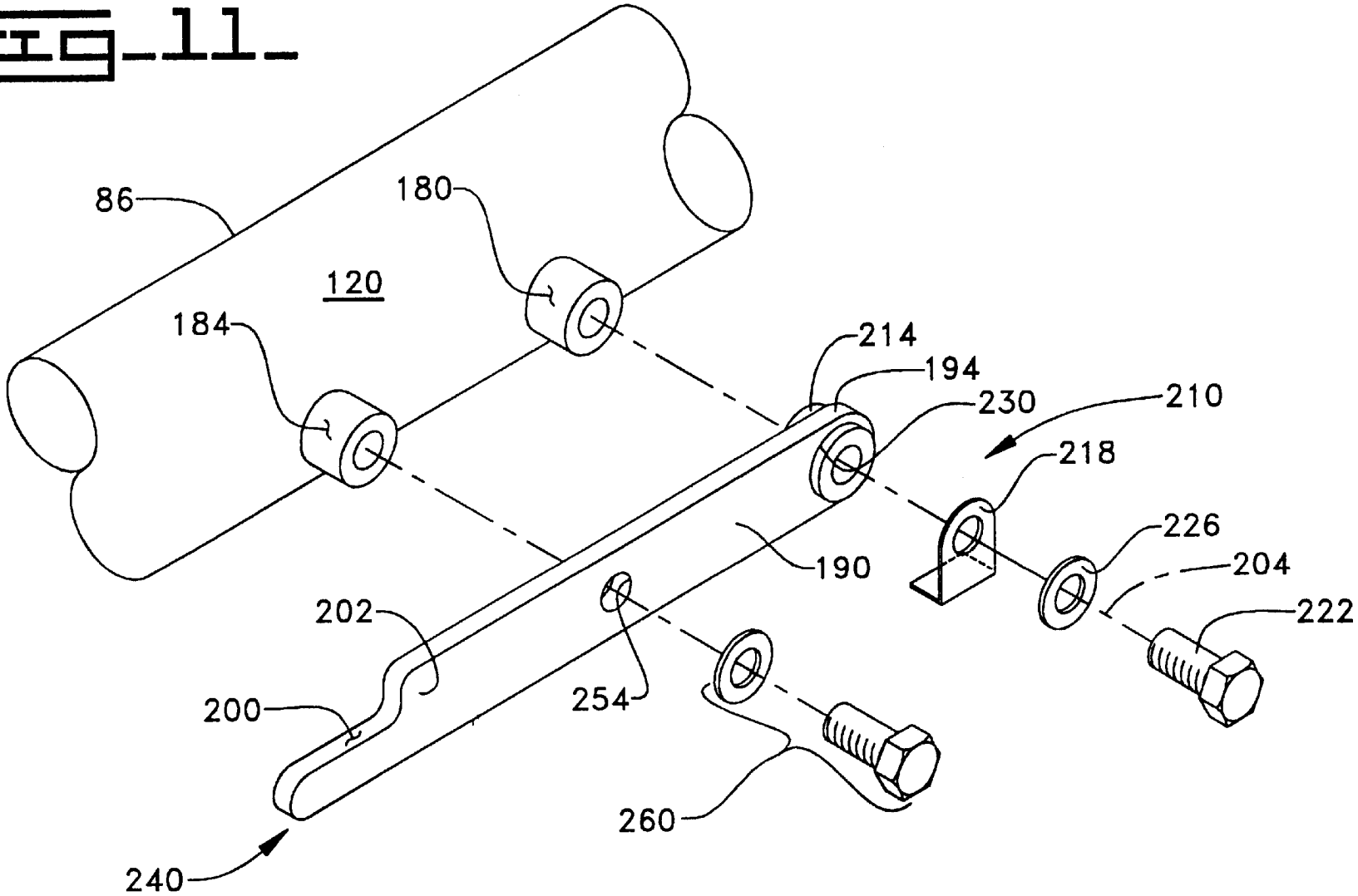
FIG. 11 is an exploded view taken along line 11—11 of FIG. 3 of a lift cylinder with various attached components shown perspectively therefrom.

As best seen in FIGS. 1–2 & 4, the lift actuator 86 is a conventional hydraulic cylinder and includes a tubular body 120 with a proximal end 124 pivotally mounted to the tower assembly 40 and a distal end 130 opposite the proximal end 124. The hydraulic cylinder 86 further includes a rod 134 with a proximal end 138 pivotally mounted on a pivot pin 142 between the pair of sideplate portions 74 at a midpoint of the liftarm assembly 60. A distal end 150 of the rod 134 is connected with and extendable from the body 120 in a well known manner. The body 120 of the hydraulic cylinder 86 has a diameter 158 which is greater than the diameter 162 of the rod 134 to define a shoulder portion 168 at the distal end 130 of the body 120. A pair of spaced bosses 180,184, seen in FIG. 11, are connected to an outer surface of the body 120 of the hydraulic cylinder 86 proximate the distal end 130 thereof.

A release lever 190, seen in FIGS. 1–9 & 11, includes a pivot end portion 194, a notched end portion 200 opposite the pivot end portion 194, and a body 202 between the pivot end portion 194 and notched end portion 200. The pivot end portion 194 of the release lever 190 is pivotably connected at a pivot point 204 to the body 120 of the hydraulic cylinder 86 in any suitable manner, such as through a pivot assembly 210. The pivot assembly 210, shown more clearly in FIG. 11, includes a sleeve 214, clip 218, bolt 222, and washer 226. The release lever 190 is slidingly disposed on the sleeve 214 by means of a defined pivot hole 230 which circumferentially surrounds the sleeve 214. The bolt 222 extends through the sleeve 214 and is threaded into the boss 180. The clip 218 retains the release lever 190 on the sleeve 214 in a pre-set position and is disposed between the washer 226 and sleeve 214 in any suitable manner. The release lever 190 is movable between a rest position 240, shown in FIGS. 1–4, and a working position 250, shown in FIGS. 5–9. The release lever 190 includes a defined stowing hole 254 therethrough which is spaced at a substantially equal distance from the pivot hole 230 as the distance between the pair of bosses 180,184. A bolt and washer assembly 260 attach the release lever 190 securedly on the hydraulic cylinder 86. The bolt and washer assembly 260 function in a well known manner so that the bolt extends through the stowing hole 254 and is threaded into the boss 184 to stow the release lever 190 in the rest position 240 wherein the notched end portion 200 faces away from the rod 134. The release lever 190 is adjacent and parallel with the body 120 of the hydraulic cylinder 86 when in the rest position 240.

Figure 10:
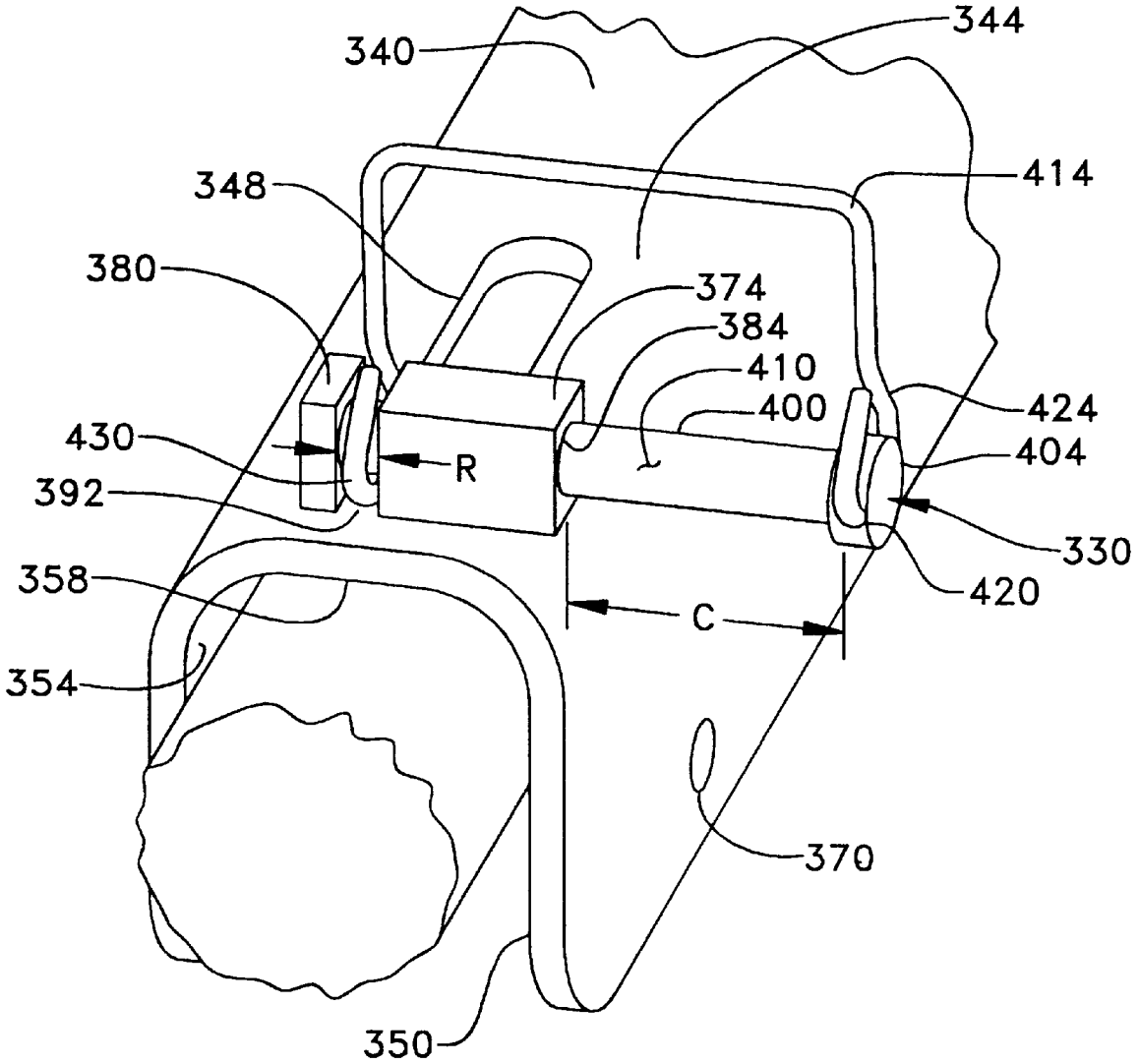
FIG. 10 is a view taken along line 10—10 of FIG. 4 which represents a portion of a lockbar of the present invention used during releasing the liftarm to the lowered position.
Figure 12:
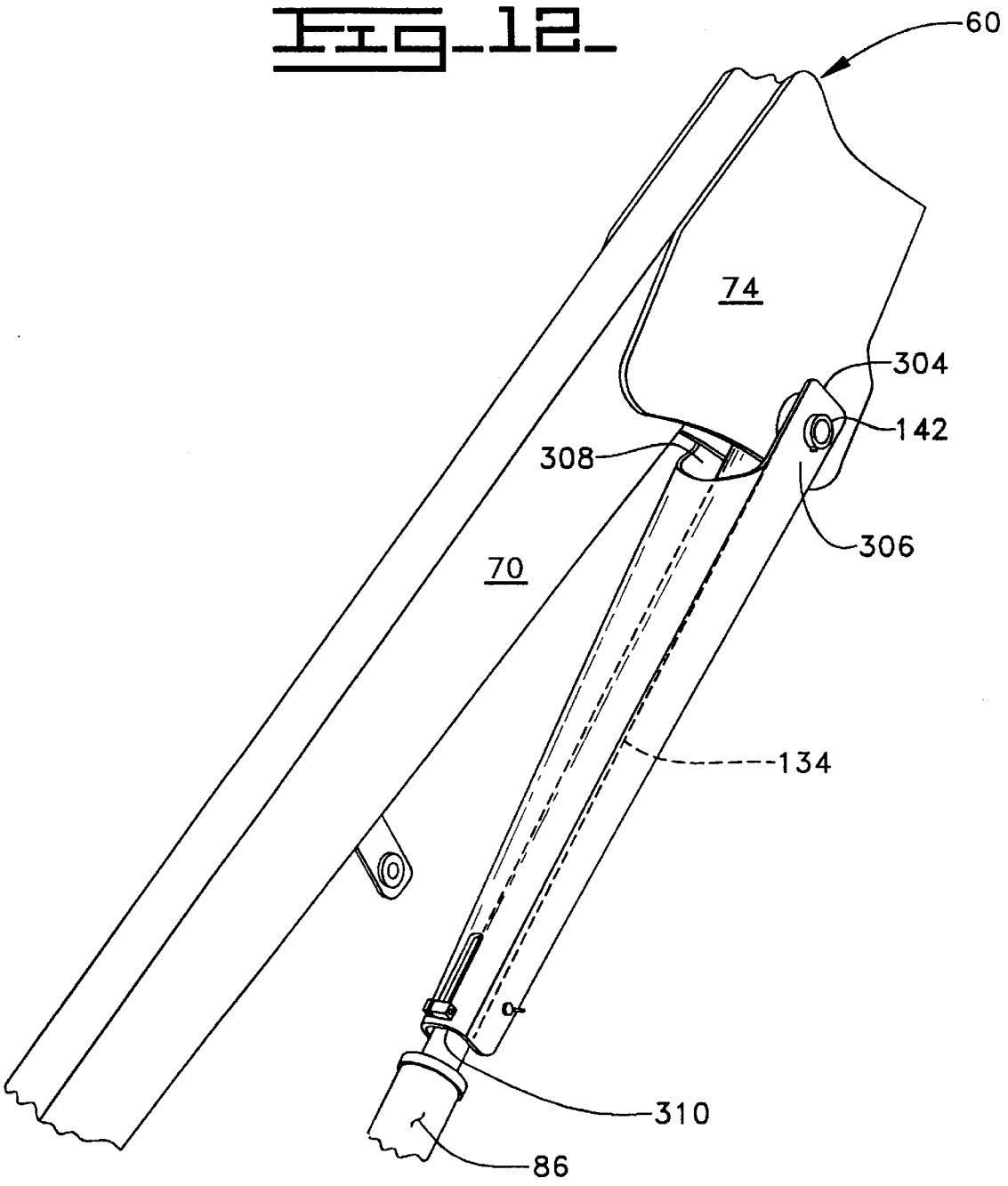
FIG. 12 is a perspective view of a connection of the liftarm with the lockbar and lift cylinder at a single pin joint incorporated in the present invention.

A substantially channel-shaped lockbar 300, seen more clearly in FIGS. 10 & 12, has a proximal end 304 with a pair of bifurcated legs 306,308 pivotally connected on the pivot pin 142, and a distal end 310. Each of the legs 306,308 are connected to the pivot pin 142 at an outer surface of a respective sideplate portion 74 and straddle the rod 134. It should be understood that the legs 306,308 may be connected at an inner surface of a respective sideplate portion 74 or in any suitable position. The lockbar 300 is movable between an inoperative position 314, shown in FIGS. 1–3, and an operative position 320, shown in FIGS. 4–9. The distal end 310 is releasably attached by a pin assembly 330 to the stow bar 78 when the lockbar 300 is in the inoperative position 314.

The lockbar 300 includes a formed top wall 340 with a planar portion 344 which defines a slotted opening 348 therethrough and a pair of spaced side walls 350,354 which extend downwardly from the top wall 340. The top wall 340 has a lower surface 358 and each of the side walls 350,354 define an opening, one of which is shown at 370, therethrough which are substantially coaxially aligned. The side walls 350,354 at the distal end portion 310 are spaced apart by a distance smaller than the diameter 158 of the body 120 of the hydraulic cylinder 86 and greater than the diameter 162 of the rod 134 of the hydraulic cylinder 86. The distal end 310 of the lockbar 300 includes a tab 374 with a bore 384 therethrough and a stop 380. The tab 374 and the stop 380 are connected to the top wall 340 in any suitable manner, such as welding, and extend upwardly therefrom opposite the spaced side walls 350,354 and adjacent the slotted opening 348. The tab 374 and the stop 380 are positioned so that a portion of the tab 374 and the stop 380 extend transversely along the planar portion 344 of the top wall 340 so that a space 392 is defined therebetween.

As seen more clearly in FIG. 10, the pin assembly 330 includes a pin 400 with a head portion 404 and an elongated body portion 410 extending from the head portion 404 and a formed retaining clip 414. The head portion 404 of the pin 400 has a transverse bore 420 therethrough. The retaining clip 414 has a locking end portion 424 which extends through the transverse bore 420 and is thereafter formed into a triangular shape to fix the retaining clip 414 on the head portion 404 of the pin 400. A retaining end portion 430 of the retaining clip 414 opposite the locking end portion 424 includes a triangular shape which has an inner area capable of circumferentially surrounding the diameter of the body portion 410 of the pin 400 for releasable connection therewith.

Industrial Applicability

The releasable locking mechanism 20 enables the hydraulic cylinder 86 to be locked in an extended position in order to hold liftarm assembly 60 in the raised position 66 during maintenance or repair of the skid steer loader 10. Further, the releasable locking mechanism 20 enables the locked hydraulic cylinder 86 to be released in order to bring the liftarm assembly 60 to the lowered position 62. The operator (not shown) cooperates manually with the releasable locking mechanism 20 to accomplish the locking and releasing function only when the liftarm assembly 60 is in the lowered position 62 or when the hydraulic cylinder 86 is locked in the extended position.

Figure 3:
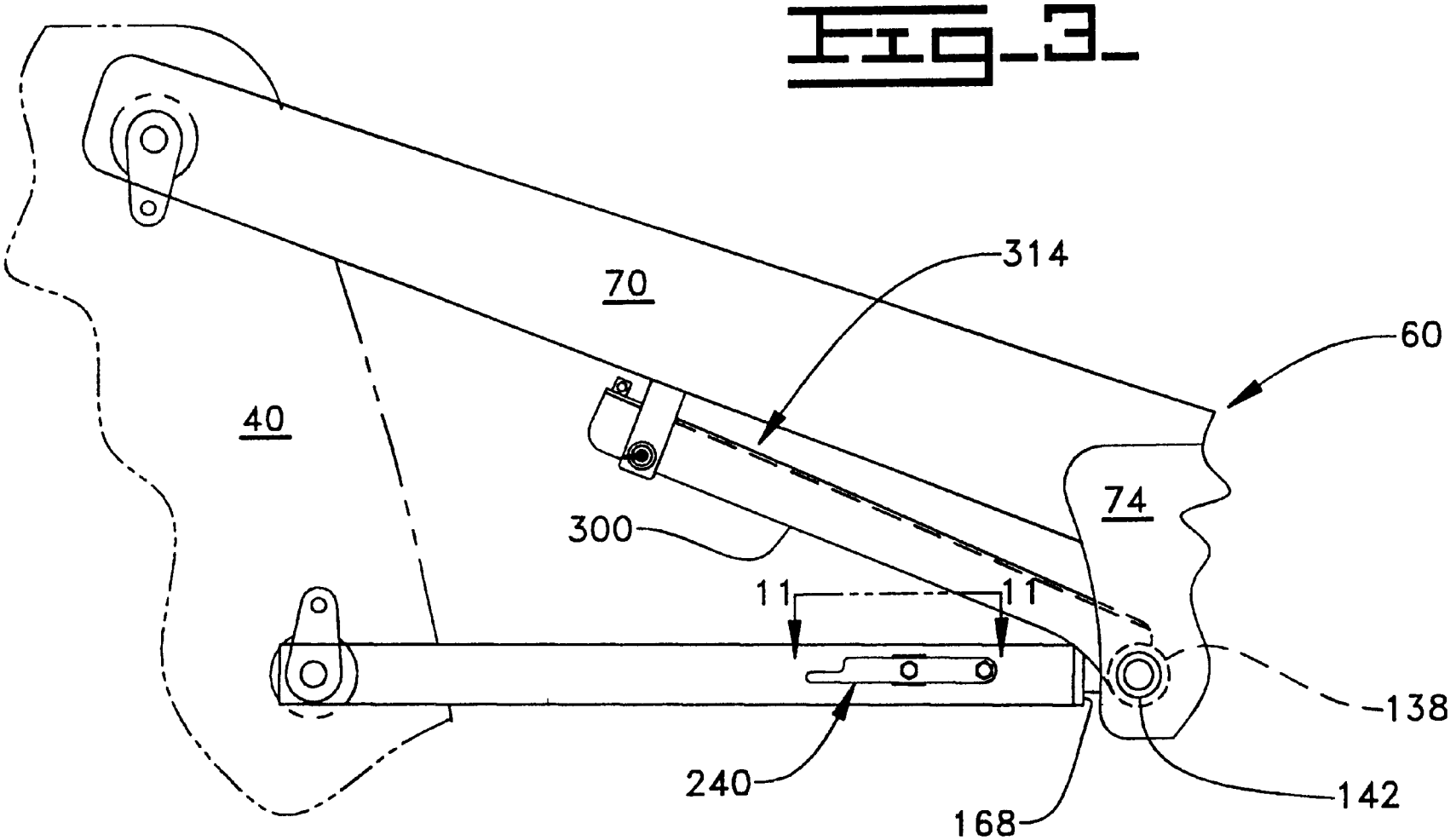
FIGS. 3–4 represent the steps of using the present invention to lock a liftarm of the skid steer loader in a raised position.

During normal operation of the skid steer loader 10, the lockbar 300 is stowed in the inoperative position 314, as seen in FIGS. 1–3. In order to hold the lockbar 300 in the inoperative position 314, the stow bar 78 extends through the slotted opening 348 until the opening 80 therethrough is coaxially aligned with the openings 370 in the side walls 350,354 so that the pin 400 may extend through the respective openings 80,370. The retaining end portion 430 of the retaining clip 414 is pressed onto the body portion 410 of the pin 400 to retain the pin 400 within the openings 80,370. Further, the release lever 190 is maintained in the rest position 240.

The locking of the hydraulic cylinder 86 is accomplished by moving the lockbar 300 from the inoperative position 314 to the operative position 320 while the liftarm assembly 60 is in the lowered position 62. This movement is initialized by forcing the retaining end portion 430 of the retaining clip 414 from the body portion 410 of the pin 400 and removing the pin 400. The lockbar 300 is then free to seat on the body 120 of the hydraulic cylinder 86. The rod 134 is extended so that the liftarm assembly 60 exceeds the raised position 66. The lockbar 300 is moved along the body 120 of the hydraulic cylinder 86 for seating a portion of the lower surface 358 of the top wall 340 adjacent the distal end 130 of the body 120 of the hydraulic cylinder 86 on the rod 134. A portion of the side walls 350,354, which includes the openings 370, extends beyond the diameter of the rod 134. The rod 134 is retracted so that the distal end 310 of the lockbar 300 is in bearing engagement with the shoulder 168 of the hydraulic cylinder 86, as seen in FIG. 4, thus, preventing further retraction of the rod 134. The pin 400 is stored while the lockbar is in the operative position 320 by extending the pin 400 through the openings 370 which traps the rod 134 within the channel shape between the side walls 350,354. The retaining end portion 430 of the retaining clip 414 is pressed onto the body portion 410 of the pin 400 to retain the pin 400 within the openings 370.

Figure 5:
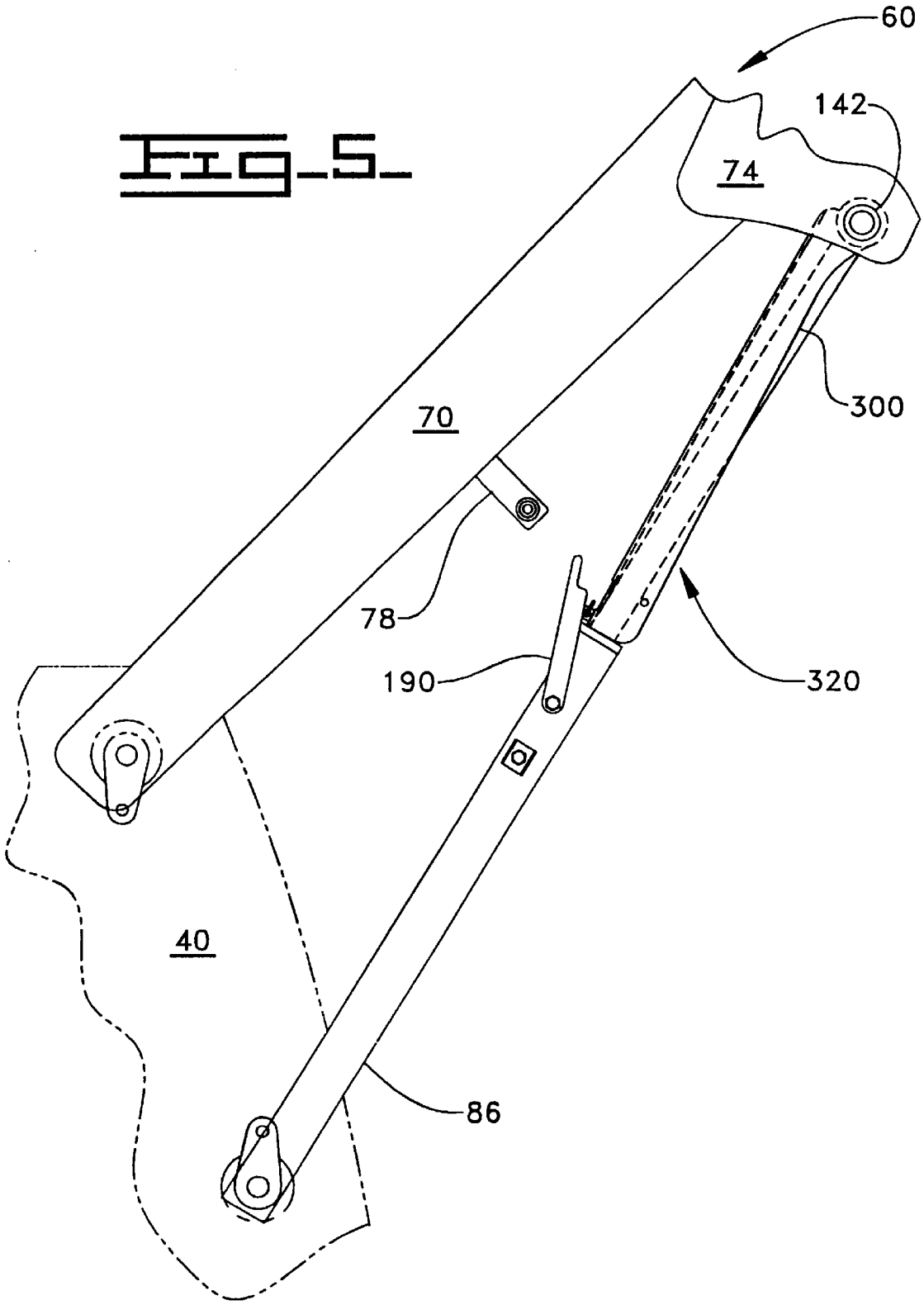
FIGS. 5–9 represent the steps of using the present invention to release the liftarm of the skid steer loader in order to be moved to a lowered position.
Figure 6:
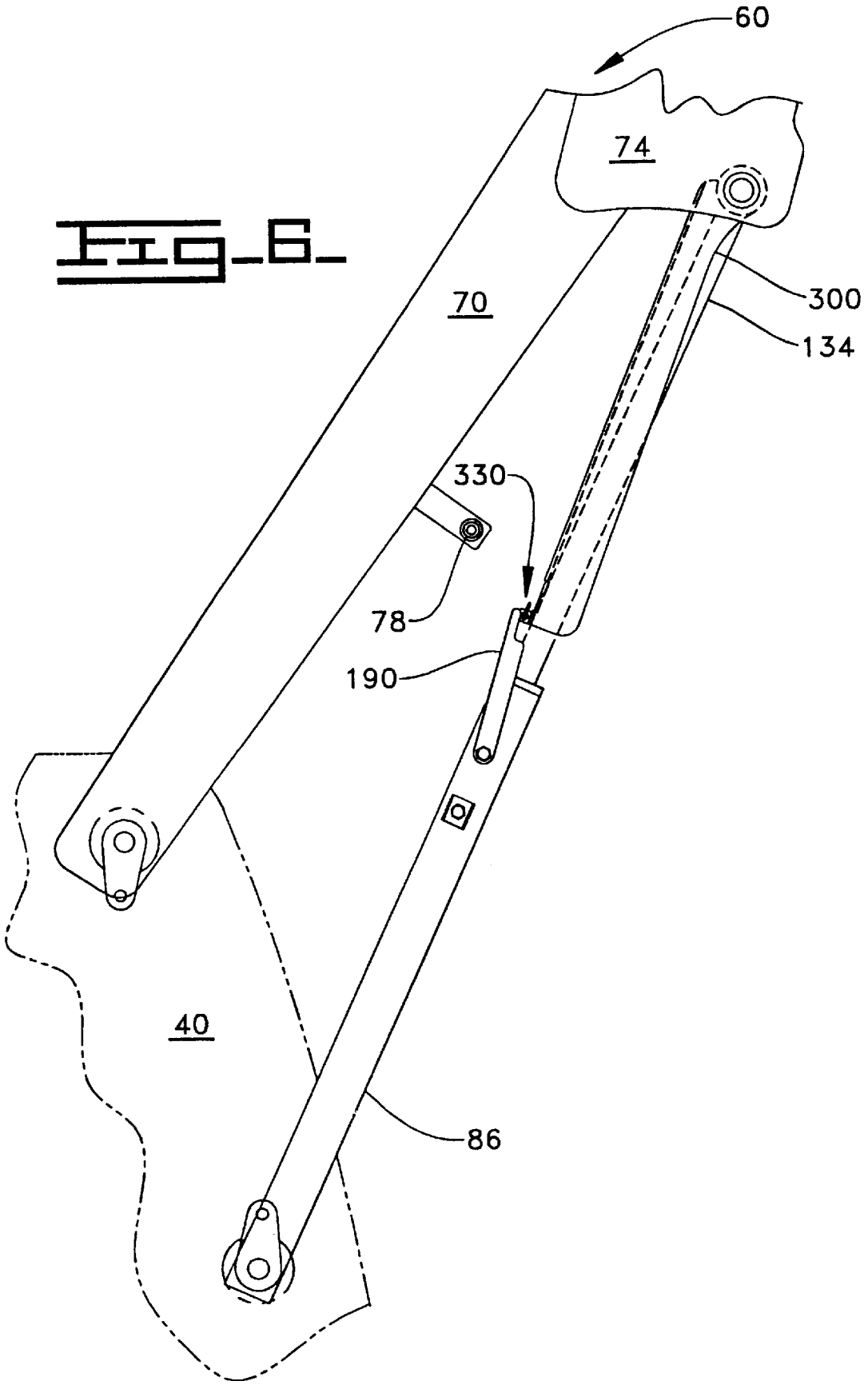
Figure 7:
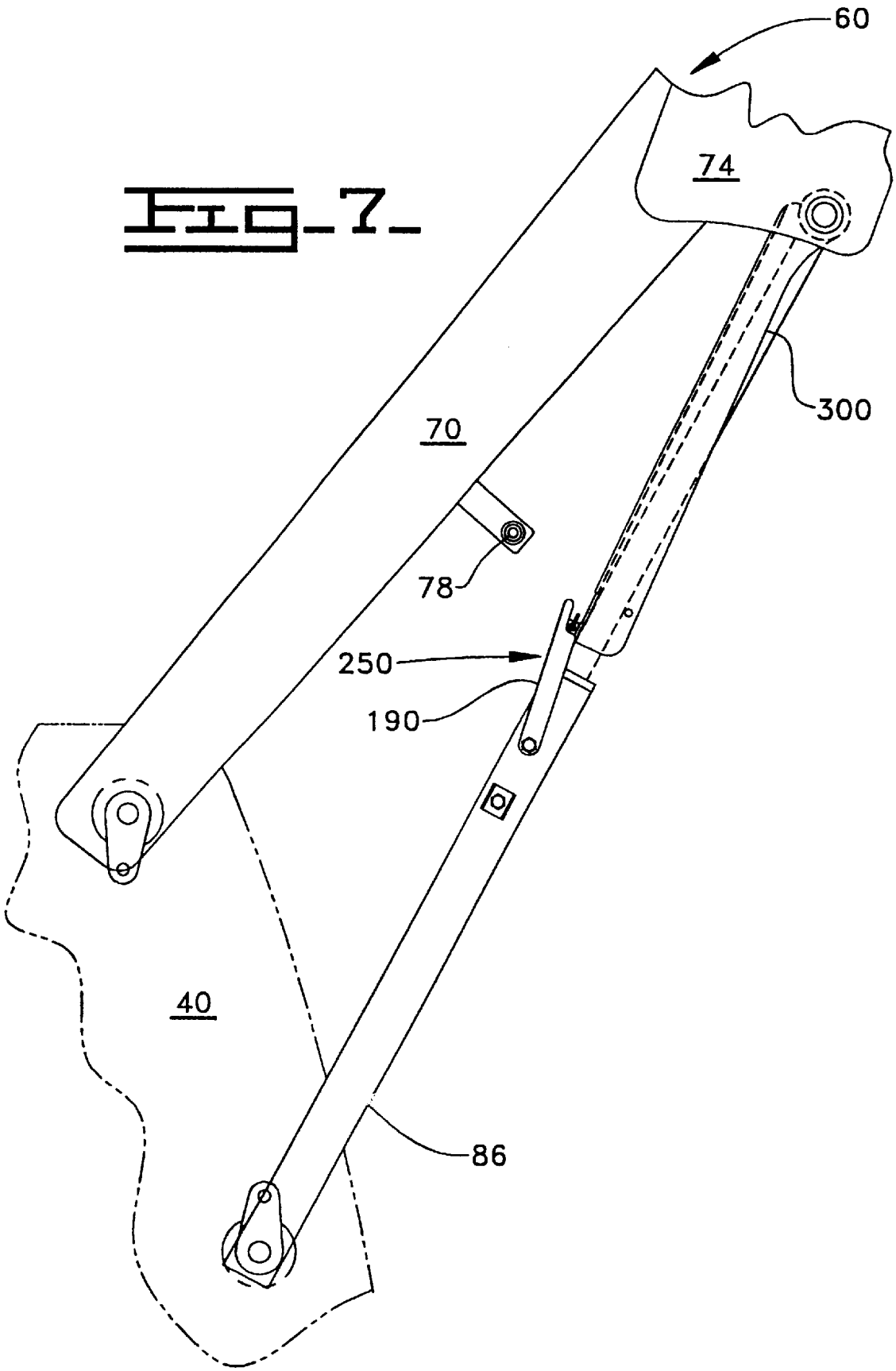
Figure 8:
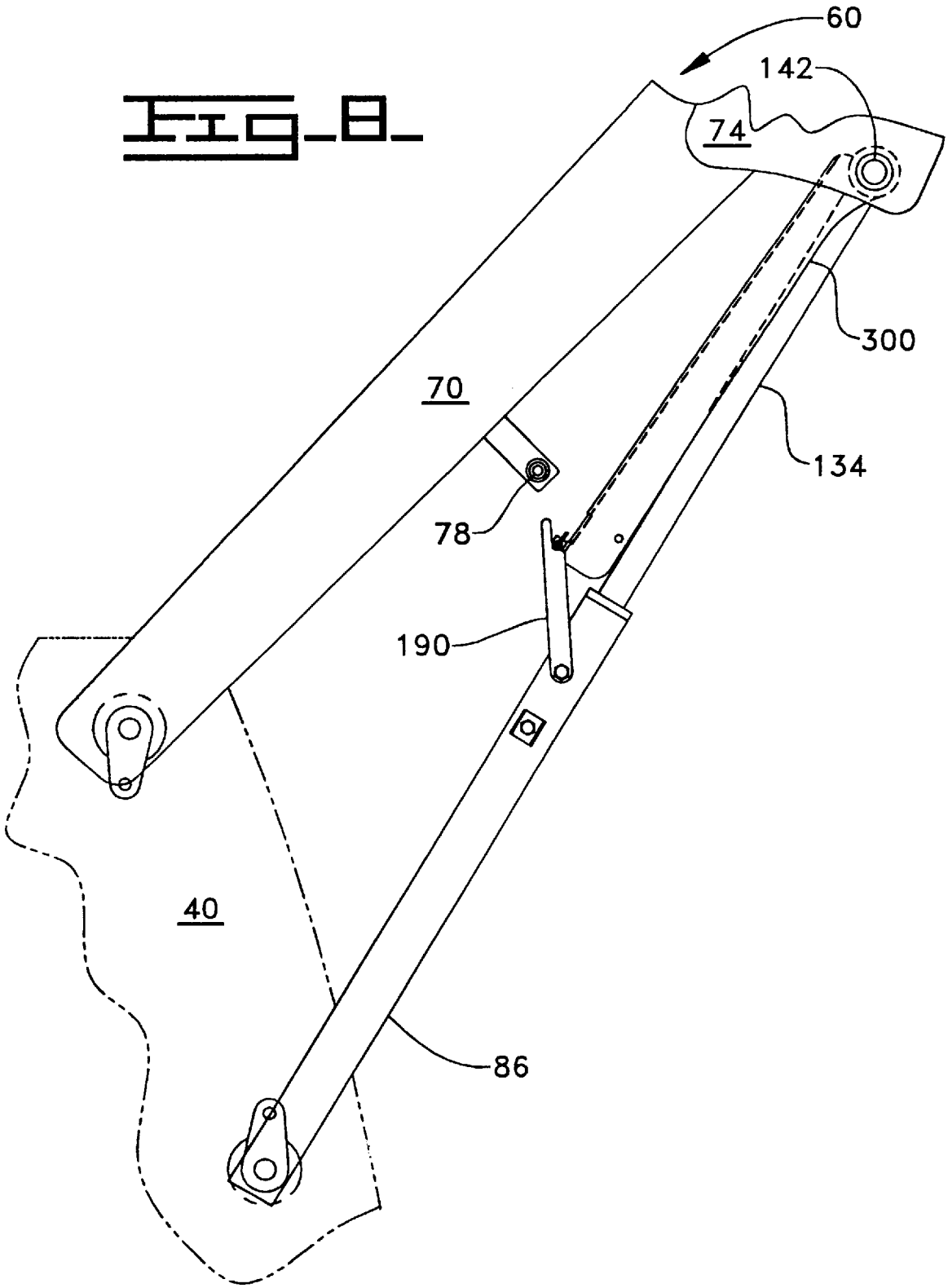
Figure 9:
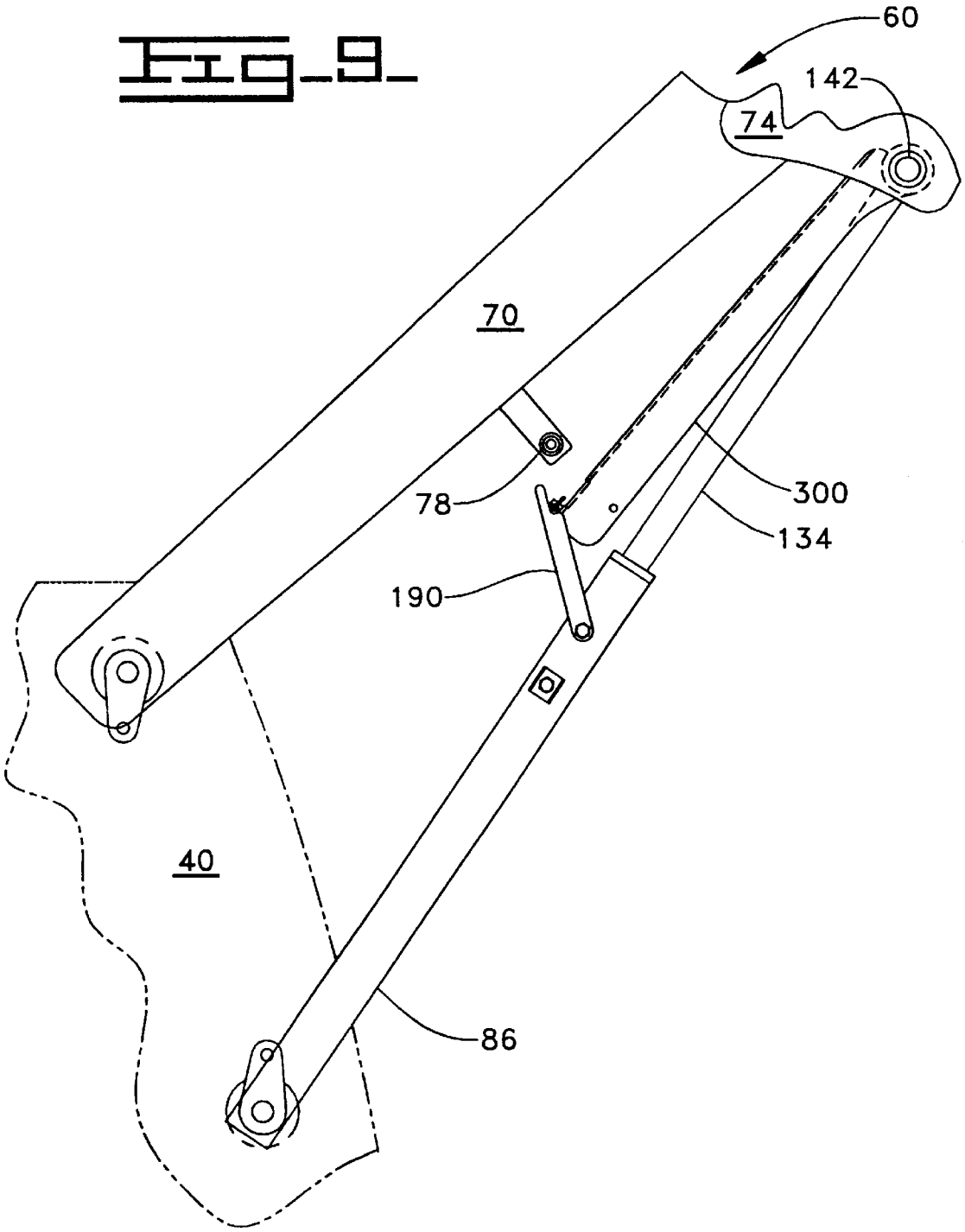

To release to the locked hydraulic cylinder 86, the retaining end portion 430 of the retaining clip 414 is forced from the body portion 410 of the pin 400 and the pin 400 is removed. The pin 400 is extended through the bore 384 in the tab 374 for abutment against the stop 380. The retaining end portion 430 of the retaining clip 414 is pressed onto the body portion 410 of the pin 400 at a retaining area (R) defined within the space 392 between the tab 374 and the stop 380 to retain the pin 400 within the bore 384 in the tab 374. A portion of the pin 400 extends from the tab 374 opposite the stop 380 to define a contact area (C) on the body portion 410 of the pin 400 and establishes a spaced relationship between the tab 374 and the head portion 404 of the pin 400. The release lever 190 is pivoted from the rest position to a segment of the working position 250 by removing the bolt assembly 260. The body 202 of the release lever 190 is seated on the contact area (C) on the pin 400, as seen in FIG. 5. The rod 134 of the hydraulic cylinder 86 is extended beyond the raised position 66 of the liftarm assembly 60 so that the release lever 190 rides along the contact area (C) on the pin 400 and seats the notched end portion 200 of the release lever 190 thereon, as seen in FIGS. 6–7. The rod 134 of the hydraulic cylinder 86 is retracted to force the notched end portion 200 against the pin 400 to lift the lockbar 300 out of bearing engagement with the body of the hydraulic cylinder 86, as seen in FIG. 8. The rod 134 of the hydraulic cylinder 86 is retracted to move the liftarm assembly 60 to the lower position 62. During retraction of the rod 134, the release lever 190 is forced rearward, substantially into the rest position 240. Simultaneously, the lockbar 300 will drop onto the body 120 of the hydraulic cylinder 86 for movement therealong until the retraction of the rod 134 is complete. The release lever 190 and the lockbar 300 may then be stowed in the rest and inoperative positions 240,314, respectively, as seen in FIG. 3.

Other aspects, objects and advantages of this invention can be obtained from a study of the drawings, disclosure and the appended claims.

What is claimed is:

1. A releasable locking mechanism adapted for use with a liftarm which is connected to and operatively associated with a lift cylinder for movement between raised and lowered positions, the lift cylinder having a body and an extendable rod, comprising:

a lockbar having first and second end portions, the second end portion pivotally connectable to the liftarm for movement between an inoperative position wherein the first end portion is releasably connectable to the liftarm and an operative position wherein the first end portion is in bearing engagement with the body of the lift cylinder to prevent retraction of the rod; and a release lever releasably connectable to the body of the lift cylinder and having a notched end portion, the release lever movable between a rest position wherein the release lever is adjacent and substantially parallel with the lift cylinder and a working position wherein the notched end portion of the release lever is forced against an attachment mountable on the first end portion of the lockbar to lift the lockbar out of bearing engagement with the body of the lift cylinder.

2. The locking mechanism of claim 1, wherein the first end portion of the lockbar includes a top wall and a pair of side walls extending from the top wall which are spaced apart by a distance smaller than the diameter of the body of the lift cylinder and greater than the diameter of the rod of the lift cylinder, each of the side walls defining an opening therethrough which are substantially coaxially aligned.

3. The locking mechanism of claim 2, wherein the first end portion of the lockbar includes a tab extending from the top wall thereof opposite the spaced side walls, the tab defining an opening therethrough.

4. The locking mechanism of claim 3, wherein the top wall of the lockbar has a lower surface which can bear against the rod of the lift cylinder and a portion of the side walls can extend a predetermined distance beyond the diameter of the rod of the lift cylinder when the lockbar is in the operative position so that the openings in the side walls are located in the side wall portions extending beyond the diameter of the rod of the lift cylinder.

5. The locking mechanism of claim 4, wherein the attachment comprises a pin having a first position wherein the pin extends through the openings in the side walls when the lockbar is in the inoperative position, a second position wherein the pin extends through the openings in the side walls when the lockbar is in the operative position, and a third position wherein the pin extends through the opening in the tab when the lockbar is in the operative position.

6. The locking mechanism of claim 5, wherein the pin is removable from the lockbar to facilitate the movement of the lockbar to the operative position.

7. The locking mechanism of claim 5, including a stop extending from the top wall of the lockbar in a spaced relationship with the tab, the pin being abutted against the stop when the pin is in the third position to define a retaining area on the pin located between the tab and the stop and a contact area on the pin which extends from the tab opposite the stop.

8. The locking mechanism of claim 7, wherein the notched end portion of the release lever bears against the pin at the contact area when the release lever is in the working position and is forced thereagainst to lift the lockbar out of bearing engagement with the body of the lift cylinder.

9. The locking mechanism of claim 7, wherein the pin has first and second end portions with the first end portion having a bore therethrough.

10. The locking mechanism of claim 9, including a retaining clip having a locking end portion and a retaining end portion, the locking end portion extending through the bore on the first end portion of the pin for connection therewith and the retaining end portion releasably connected on the second end portion of the pin within the retaining area.

11. The locking mechanism of claim 10, wherein the retaining end portion of the retaining clip has a triangular shape which substantially circumferentially surrounds the pin at the second end portion, the retaining end portion being in contact with the top wall of the lockbar and positioned in a predetermined manner to prevent movement of the retaining clip.

12. A machine having a body, comprising:

a liftarm pivotally mounted to the body;

a lift cylinder having a housing pivotally mounted to the body of the machine and an extendable rod connected to the liftarm, the lift cylinder operatively associated with the liftarm for moving the liftarm between raised and lowered positions; and a releasable locking mechanism including a lockbar and a release lever, the lockbar having first and second end portions with the second end portion pivotally connected to the liftarm for movement between an inoperative position wherein the first end portion is releasably connected to the liftarm and an operative position wherein the first end portion is in bearing engagement with the housing of the lift cylinder to prevent retraction of the rod, the release lever pivotally connected to the housing of the lift cylinder and being movable between a rest position and a working position, the release lever being forced against the lockbar when the release lever is in the working position for moving the lockbar out of bearing engagement with the housing of the lift cylinder.

13. The machine of claim 12, wherein the release lever has a notched end portion and the release lever is adjacent and substantially parallel with the lift cylinder when in the rest position and the notched end portion of the release lever is forced against an attachment mounted on the first end portion of the lockbar when in the working position.

14. The machine of claim 13, wherein the first end portion of the lockbar includes a top wall and a pair of side walls extending from the top wall which are spaced apart by a distance smaller than the diameter of the housing of the lift cylinder and greater than the diameter of the rod of the lift cylinder, each of the side walls defining an opening therethrough which are substantially coaxially aligned.

15. The machine of claim 14, wherein the first end portion of the lockbar includes a tab extending from the top wall thereof opposite the spaced side walls, the tab defining an opening therethrough.

16. The machine of claim 15, including a stop extending from the top wall Of the lockbar in a spaced relationship with the tab and the attachment includes a pin extending through the opening in the tab for abutment against the stop to define a retaining area on the pin located between the tab and the stop and a contact area on the pin which extends from the tab opposite the stop.

17. The machine of claim 16, wherein the notched end portion of the release lever bears against the pin at the contact area when the release lever is in the working position.

18. The machine of claim 13, wherein the rod of the lift cylinder and the lockbar are connected to the liftarm at substantially the same location.

19. A method of locking a lift cylinder having a body and an extendable rod in an extended position in order to hold a lift arm of a machine in a raised position and releasing the locking of the lift cylinder in order to bring the lift arm to a lowered position, comprising the steps of:

providing a lockbar with first and second end portions and a release lever with a notched end portion;

pivotally connecting the second end portion of the lockbar to the lift arm;

pivotally connecting the release lever to the body of the lift cylinder;

moving the lockbar from an inoperative position wherein the first end portion is releasably connected to the liftarm to an operative position wherein the first end portion is in bearing engagement with the body of the lift cylinder to prevent retraction of the rod; and moving the release lever from a rest position adjacent and substantially parallel with the lift cylinder to a working position wherein the notched end portion is forced against an attachment mountable on the first end portion of the lockbar to lift the lockbar out of bearing engagement with the body of the lift cylinder.

20. The method of locking a lift cylinder of claim 19, wherein the step of moving the lockbar to the operative position includes the steps of:

manufacturing the lockbar with a channel shape having a top wall, a pair of side walls extending from the top wall, and a tab extending from the top wall opposite the pair of side walls;

extending a pin through an opening in the side walls for releasably connecting the lockbar to the lift arm;

removing the pin from the opening in the side walls when the rod of the lift cylinder is in the non-extended position;

extending the rod (134) so that the lockbar moves along the body of the lift cylinder until the first end portion thereof drops onto the rod; and retracting the rod until the lockbar is in the operative position.

21. The method of locking a lift cylinder of claim 20, including the step of:

extending the pin through the openings in the side walls so that the pin can be stored when the lockbar is in the operative position.

22. The method of releasing a lift cylinder of claim 21, including the steps of:

removing the pin from the side walls when the lockbar is in the operative position;

extending the pin through an opening in the tab to define the attachment;

moving the release lever from the rest position to the working position wherein the release lever contacts the pin;

extending the lift cylinder beyond the extended position wherein the notched end portion of the release lever contacts the pin; and retracting the lift cylinder to force the notched end portion against the pin for lifting the lockbar out of bearing engagement with the body of the lift cylinder.

* * * * *